United States Patent [19]

Stirtz

[11] Patent Number: 4,688,674

[45] Date of Patent: Aug. 25, 1987

[54] SACK AND ROPE ASSEMBLY

[76] Inventor: Ronald H. Stirtz, 1660 Lorane Hwy., Eugene, Oreg. 97405

[21] Appl. No.: 871,302

[22] Filed: Jun. 6, 1986

[51] Int. Cl.[4] ..... B65D 77/00

[52] U.S. Cl. ..... 206/388; 242/1; 242/159

[58] Field of Search ..... 206/388, 389, 63.3, 206/408–410; 242/1, 159, 171–173

[56] References Cited

U.S. PATENT DOCUMENTS 4,593,815 6/1986 Wright ..... 206/410

FOREIGN PATENT DOCUMENTS 1229241 11/1966 Fed. Rep. of Germany ..... 206/410

2750582 5/1979 Fed. Rep. of Germany ..... 242/172

*Primary Examiner*—Jimmy G. Foster

*Attorney, Agent, or Firm*—Kolisch, Hartwell & Dickinson

[57] ABSTRACT

A line and sack assembly providing for the storage of a continuous length of line. A sack is disclosed of mesh construction and line is stored within the sack formed as multiple collections of line following one another and serially located in the interior of the sack. The sack has a closable throat at one end through which line is payed out when needed and which is opened up when reloading the sack with line.

9 Claims, 4 Drawing Figures

SACK AND ROPE ASSEMBLY

BACKGROUND AND SUMMARY OF THE INVENTION

This invention relates to a line and sack assembly, the assembly having such a construction as to provide for the storage of a continuous length of line in a manner permitting controlled portions of the line to be payed out in an orderly fashion and without snarling and knotting of the line.

The line and sack assembly has a multiplicity of uses. For instance, such may be used in the storing of a length of rope in a car, boat, or other vehicle with the rope in readiness for use in emergencies, or for other use (such as a tow rope for waterskiing, or as an anchor rope for a boat). The term "line" is used broadly herein, and includes within its definition an article such as an elongate electric extension cord such as might be used in supplying current to electric mowers and chain saws.

It is widely recognized that a continuous, elongate length of line is an extremely useful if not necessary commodity to have at hand. When not in use, a line may be wound in windings or, more often than not, merely stored as a clump of line. In either case, and particularly if the line is moved from one location to another during nonuse, the line becomes snarled and intertwined, and ends of the line are difficult to locate. Furthermore, in such a state, there is no provision for paying out different amounts of line in a controlled manner, as needed under the circumstances.

What the invention contemplates in a specific embodiment of the invention, is the provision of an elongate sack, preferably of a mesh construction. Line is stored within the sack, with the line formed as multiple collections of line following one another, and such collections being serially located in the interior of the sack. Each collection of line contains passes of line which are unsecured to each other within the sack, and which are restrained so as to be held in place in a loose manner by the transverse extent of the sack. One extremity of the line appears at one end of the sack, and the other extremity of the line appears at the other end of the sack.

In such a state, the line in its collections does not become snarled or knotted. The line is easily payed out in a controlled manner, by pulling on one of the rope extremities and by squeezing on the sack exterior to control the flow of line. As line is pulled from the sack, it first pulls from the collection or accumulation of line appearing at one end of the sack, and when such is fully exhausted, then pulls from the next line accumulation or collection which appears in series with the just exhausted collection.

Provision is made through the presence of an enlarged closeable opening at one end of the sack to reload the sack with serially located accumulations or collections, after use of the rope and for storage purposes. With the sack reloaded, the line is maintained in an ordered manner, whether the sack be moved from place to place, be stepped upon, or bent on itself for storage purposes.

A general object of the invention, therefore, is to provide a unique line and package assembly where the line in the assembly is maintained in an ordered manner and which permits paying out of different amounts of line in a controlled manner.

Another object is to provide such an assembly where the line is readily returned after use to the sack which stores it.

These and other objects and advantages are attained by the invention, which is described hereinbelow in conjunction with the accompanying drawings, wherein.

Figure 1:
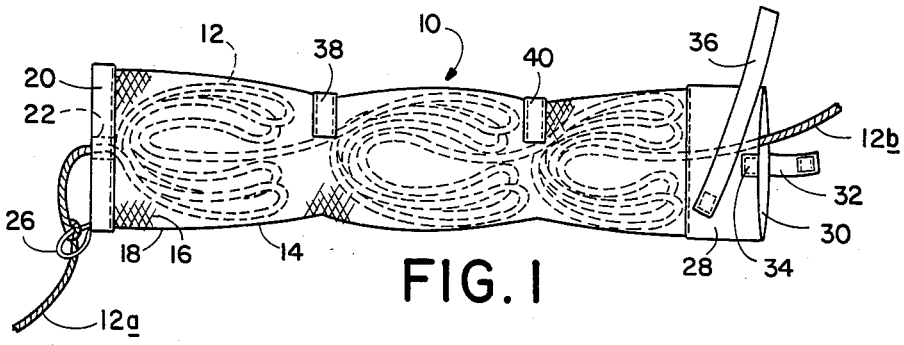
FIG. 1 is a side view of the line and package system as contemplated in one embodiment of the invention, such including an elongate envelope or sack containing collections of line lodged within it, and with extremities of the line projecting from opposite ends of the sack.

Referring now to the drawings for a more detailed description of a specific form of the invention, the line and package assembly illustrated comprises an elongate sack, shown at 10, which has lodged within it accumulations of an elongate continuous rope. The rope given, the general reference numeral 12, has end extremities 12*a* and 12*b* projecting out from opposite ends of the sack.

Sack 10, in a specific and preferred embodiment of the invention, comprises an elongate, substantially cylindrical, i.e., tubular body, composed of an open, flexible and pliable mesh material, designated at 14. Strands, such as those shown at 16 and 18, extend across each other to form the open mesh. The strands may have a plastic composition, imparting water and abrasion resistance, although other compositions may be employed. By reason of the mesh construction, drainage and drying of its contents are promoted. Furthermore, the open mesh permits visual observation of the state of the contents of the sack. As will hereinafter be described, when the user applies hand grip pressure to the exterior of the sack, the mesh construction promotes a readily applied frictional gripping of the rope as such is payed out from the sack. In some embodiments, a sack may be used having a flat envelope configuration.

Suitably secured, as by stitching it to the mesh material forming body 14, and at the left end of the sack in FIG. 1, is a bordering ribbon of fabric material 20. Body 10 is flattened out at this end to bring opposed expanses of this bordering material up against each other, and these opposed expanses for the most part are stitched together to close off this end of the body over a major portion of its extent. A central region, however, is unstitched, to leave an opening 22 which accommodates the passage therethrough of end extremity 12*a* of the rope. The opening, however, is not so large as to permit a bundle or accumulation of rope to pass bodily through the opening.

The end of body 14 being described may also be provided with a fabric loop, shown at 26, with ends of the loop sewn to material 20. If end extremity 12*a* of the rope is passed through this loop and thence over and under itself in a loose knot, such will serve to secure the sack to the rope while permitting the end extremity where such passes beyond the loop to be used in securing the rope to a cleat or other fastening device.

The opposite end of sack 10 is provided with what is referred to herein as a collar 28, which may be of a wear resistant fabric material, and suitably secured to the mesh material forming body 14. This collar bounds an opening at this end of the sack given the reference number 30. The collar may include a stiffener, such as a plastic sheet piece, inside it, whereby the collar better yieldably retains its shape.

Opening 30, which has the same circumferential extent as mesh body 14, provides a throat leading into the sack and accommodates the manual insertion therethrough of the hand with such hand gripping a collection of rope. The opening, therefore, accomodates the return of rope into the sack in the reloading of the sack.

Means is provided for detachably securing the collar to itself so as to at least partially close this opening and to prevent movement after closure of rope collections as a unit through the opening. Specifically, such means is a detachable means which, in the specific form of the invention illustrated, includes a strap 32 secured at one end to the collar and a tab 34 secured to the collar opposite the strap. The strap and tab have complementary surfacing in the form of a multiplicity of hooks forming the surfacing of one of the elements and a multiplicity of loops forming the surfacing of the other, which interengage to produce securement. Such a securement system is marketed under the trademark VELCRO.

Figure 3:
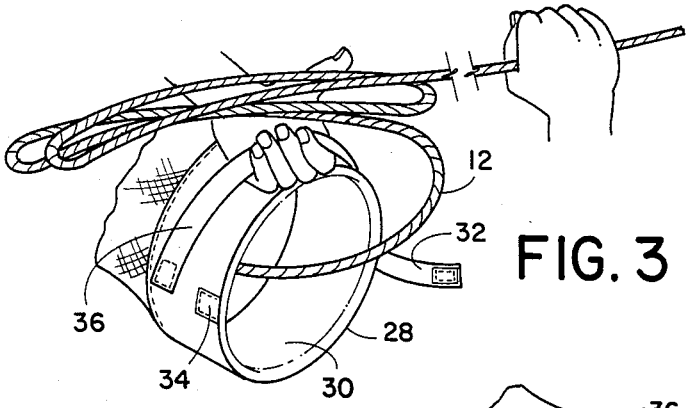
FIGS. 3 and 4 are perspective views illustrating portions of the sack and line assembly, and showing how line is handled after its use to return the line to the sack and thus repackage it.

Collar 28 also provides a mounting for a handle shown at 36. Such comprises a strap which is secured at opposite extremities to circumferentially spaced locations of the collar. The handle forms a broad loop which extends generally in the direction of the circumference of the collar, and is gripable, therefore, with one hand, with the palm side of the hand facing upwardly as shown in FIG. 3. This facilitates the forming of accumulations of rope and the loading of such accumulations into the sack, as will hereinafter be more fully described.

The sack further includes means providing at intervals along the length of the sack partial circumferential restraints or constrictions to body 14, whereby partial chambers appear serially along the length of the body. In the particular form of the invention illustrated, such comprises patches shown at 38 and 40 which may be made, for instance, of the same material as the collar and which are secured to body 14 at locations spaced inwardly from opposite extremities of this body. In securing the patches to the body, the material in the body is brought together somewhat at the time of stitching, to produce the partial constriction. As can be seen in FIG. 1, the patches, by reason of their securement, divide the body 14 into three partial chambers or compartments appearing serially along the length of the body.

While patches have been disclosed, constrictions could be produced by other means, as by providing a stretchable fabric extending in a circumferential direction on the sack at intervals along the length of the sack. These would be expandable with the insertion of rope or the hand therethrough. Alternatively, the body of the sack may be made entirely of stretchable material, with collections of line forming shaped compartments after loading of the same.

Rope 12 is loaded within the sack with such formed into accumulations or collections of rope and such collections being serially located within the sack, i.e., within the chambers appearing along the length of the sack. Each collection includes passes of rope, forming U-shaped loops, which extend back and forth with respect to each other in side-by-side relationship, and such passes of rope in a collection are unsecured with respect to each other with the collection lodged within the sack. The loops in each collection are maintained roughly in serial order produced by the preferred method of accumulating each collection, so that as a pass is needed, it tends to be the front and available pass. The rope in a collection is restrained only by the transverse extent of the sack where the rope collection is located.

Figure 4:
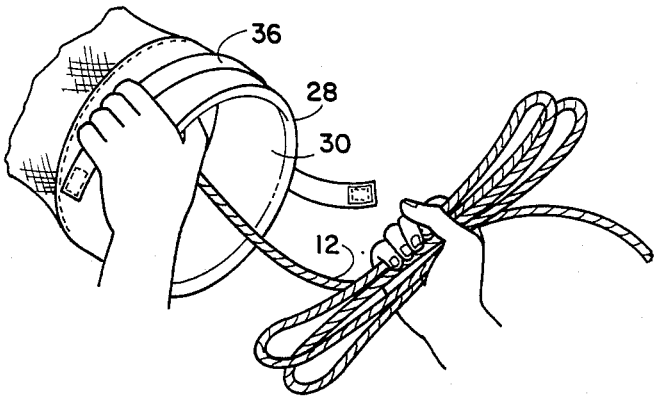

More fully explaining the loading of the sack, the handle may be gripped with one hand with the palm side up as illustrated in FIG. 3. The other hand is then used to feed rope back and forth across the palm of this hand creating loops as partially illustrated by the forming accumulation illustrated in FIG. 3. After a predetermined number of such loops has been formed, i.e., ten to fifteen, the rope is transferred from the hand holding the handle to the other hand, and the accumulation produced thrust into the throat of the sack. The hand holding the handle may be rotated forward allowing the thumb the curl inside the collar, as shown in FIG. 4, giving a firm grip on the collar. In the case of the first accumulation of rope fed into the sack, such is thrust throughout the interior of the sack to the end remote from the throat. The rope extremity which is part of this first accumulation is extended through opening 22 to be accessible for anchoring purposes if desired. The first accumulation is caused to be lodged within the first partial chamber formed by the restriction means.

After lodging the first accumulation of rope, another accumulation may be similarly prepared and such manually thrust into the next chamber within the body formed between constriction means 38 and 40. The next, and in the illustrated form of the invention the last accumulation of rope, is then prepared, and such is then manually thrust into the partial chamber which is adjacent the throat of the sack. This last accumulation is formed with the opposite end extremity of the rope extending out of the throat. After loading, strap 32 may be secured to tab 34 partially to close off the throat to prevent the accumulation of rope which is directly adjacent opening 30 from moving bodily through the opening.

With the sack so loaded with rope, the rope is maintained from knotting or snarling. The sack and its rope contents may be moved from place to place, or even folded for storage purposes, with the rope maintained in an ordered manner within the sack.

Figure 2:
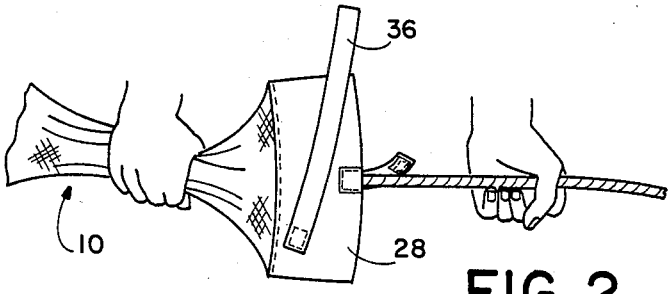
FIG. 2 illustrates one end portion of the sack shown in FIG. 1, with an opening which terminates this end portion opened up, and showing how line may be payed out from the assembly.

When rope is needed for some purpose, such is easily pulled out of the end which provides the throat of the sack as illustrated in FIG. 2. The flow of rope may be restricted to the extent desired by manually squeezing on the sack adjacent its throat, which has the effect of frictionally grasping the passes of rope within the accumulations restricted by the hand to impede the loose movement of rope outwardly. Rope in this manner may be fed, first from the accumulation which appears directly adjacent the throat, and then from the next accumulation which appears in the partial chamber adjoining the chamber just dispensed.

Line may also be payed out from the sack without detaching strip 32 from tab 34, i.e., with the throat closed. The closed throat provides a means restricting the flow of line.

In this way, part or all of the rope may be payed out to the extent desired. If the whole length of rope is to be utilized, as for instance in the towing of a water-skier, end extremity **12*a* may be secured to a suitable anchoring means such as a cleat in the boat, with the sack retained by reason of the loop 26** described.

It should be obvious from a reading of the above, that the line and sack assembly has a multiplicity of uses. It provides an extremely convenient means for the storage of line, with the line at all times immediately available for the use desired. Paying out is in an ordered manner, with the user controlling rope movement through squeezing of the sack.

While a particular embodiment of the invention has been described, it should be obvious that variations and modifications are possible without departing from the invention.

It is claimed and desired to be secured by Letters Patent:

1. A line and sack assembly comprising:

an elongate sack and means forming partial compartments disposed serially along and within the sack, said means leaving a mid-region of the sack open along the length of the sack to permit hand-loading of line into the sack, an elongate continuous line, multiple collections of line formed from the line, each collection including multiple adjacent passes of line, said collections of line being serially located along the length of the interior of the sack with each in a respective compartment, the passes of line in each collection being unsecured with respect to each other within the sack and being restrained so as to be held in place by the transverse extent of the sack, said sack having an opening at one end to accommodate hand insertion into the sack during loading of the sack with line, the collections of line including one collection adjacent said one end which includes one end extremity of the line, and another collection adjacent the opposite end of the sack which includes the opposite end extremity of the line, said sack further including means for closing said opening at said one end to an extent sufficient to prevent movement of said one collection of line through said opening.

2. A line and sack assembly comprising:

an elongate sack, an elongate continuous line, multiple collections of line formed from the line, each collection including multiple adjacent passes of line, said collections of line being serially located along the length of the interior of the sack, the passes of line in each collection being unsecured with respect to each other within the sack and being restrained so as to be held in place by the transverse extent of the sack, said sack having an opening at one end to accommodate hand insertion into the sack during loading with line and said sack at least along a mid-region thereof being open to permit hand-loading of line within the sack, the collections of line including one collection adjacent said one end which includes one end extremity of the line, and another collection adjacent the opposite end of the sack which includes the opposite end extremity of the line, said sack including an opening at said opposite end accommodating passage therethrough of said opposite end extremity of the line but restraining movement of said other collection through said opposite end, the sack further including means for closing said opening at said one end of the sack to an extent sufficient to prevent movement of said one collection through said opening.

3. The sack of claim 2, wherein the sack includes a collar encircling the opening at said one end of the sack, and means is provided for detachably securing the collar to itself so as to at least partially close said opening.

4. The assembly of claim 3, which further includes a handle joined to said collar.

5. The assembly of claim 3, wherein the sack has an elongate tubular configuration, and means is provided at intervals along the length of the sack partially restricting the circumferential extent of the sack, said means producing partial chambers appearing serially along the length of the sack, each of said partial chambers housing a collection of line.

6. A line and sack assembly comprising:

an elongate, essentially tubular sack composed of a flexible loose mesh material, an elongate continuous line, multiple collections of line being formed from the line and each collection including multiple adjacent passes of line, said collections being serially located along the length of the interior of the sack, the passes of line in each collection being unsecured with respect to each other within the sack and each collection being restrained so as to be held in place by the transverse extent of the sack, said collections of line including one collection adjacent one end of the sack and said sack having at said one end an opening accommodating hand insertion into the sack when loading the sack with line, said sack further including means for at least partially closing off said opening to an extent sufficient to prevent removal of said one collection of line.

7. The assembly of claim 6, wherein said one collection of line includes one end extremity of the line, and the assembly further includes another collection of line adjacent the opposite end of the sack which includes the opposite end extremity of the line, said opposite end of the sack including an opening permitting the extension of said opposite end extremity through the sack, but of insufficient size to permit movement of said other collection of line through said opposite end of the sack.

8. The assembly of claim 7, which further includes constriction means provided at intervals along the length of the sack partially restricting the circumferential extent of the sack, whereby partial chambers are formed appearing serially along the length of the sack, each partial chamber housing a collection of line.

9. A line and sack assembly comprising:

an elongate tubular sack composed of a flexible and pliable open mesh material, an elongate continuous line, multiple collections of line being formed from the line, each collection including multiple adjacent passes of line and said collections being serially located along the length of the interior of the sack, the passes of line being unjoined with respect to each other within the sack and each collection being restrained so as to be held in place by the transverse extent of the sack, means at intervals along the length of the sack constricting the circumferential extent of the sack, whereby partial chambers appear serially along the length of the envelope, each of the partial chambers housing a collection of line, the collections of line including one collection adjacent one end of the sack, the line having one extremity extending from this collection of line and the sack having an open end at said one end to enable manual entry of the sack in the loading of line, a collar joined to the sack and surrounding said opening, means for detachably connecting the collar to itself at said one end thus partially to close said opening sufficient to prevent a collection of line from exiting from said opening, said collections of line including a collection adjacent the opposite end of the sack and such collection including the opposite extremity of the line, said opposite end of the sack having an opening enabling said opposite extremity of the line to pass therethrough and out of the sack and said opening being of insufficient size to permit the collection of line adjacent said opposite sack end from exiting the sack.

* * * * *